US011715935B2

(12) United States Patent
Suckewer

(10) Patent No.: US 11,715,935 B2
(45) Date of Patent: Aug. 1, 2023

(54) TRAVELING SPARK IGNITER

(71) Applicant: Knite, Inc., Ewing, NJ (US)

(72) Inventor: Artur P. Suckewer, Franklin Park, NJ (US)

(73) Assignee: Knite, Inc., Ewing, NJ (US)

( * ) Notice: Subject to any disclaimer, the term of this patent is extended or adjusted under 35 U.S.C. 154(b) by 0 days.

(21) Appl. No.: 17/368,515

(22) Filed: Jul. 6, 2021

(65) Prior Publication Data

US 2022/0173577 A1 Jun. 2, 2022

Related U.S. Application Data

(63) Continuation of application No. 16/722,162, filed on Dec. 20, 2019, now abandoned, which is a (Continued)

(51) Int. Cl.
*H01T 13/52* (2006.01)
*F02P 9/00* (2006.01)
(Continued)

(52) U.S. Cl.
CPC ..... *H01T 13/52* (2013.01); *F02P 9/007* (2013.01); *F02P 23/04* (2013.01); *H01T 13/22* (2013.01); *H01T 13/34* (2013.01); *H01T 13/467* (2013.01)

(58) Field of Classification Search
CPC ..... H01T 13/22; H01T 13/52
(Continued)

(56) References Cited

U.S. PATENT DOCUMENTS 3,394,285 A * 7/1968 Lindsay ..... H01T 13/52 313/140
3,413,518 A 11/1968 Chafer et al.
(Continued)

FOREIGN PATENT DOCUMENTS

DE 10 2006 037 039 A1 2/2008
GB 2 073 313 A 10/1981
(Continued)

OTHER PUBLICATIONS

U.S. Appl. No. 16/826,123, filed Mar. 20, 2020, Suckewer et al.
(Continued)

*Primary Examiner* — Christopher M Raabe
(74) *Attorney, Agent, or Firm* — Wolf, Greenfield & Sacks, P.C.

(57) ABSTRACT

An igniter having at least two electrodes spaced from each other by an insulating member having a substantially continuous surface along a path between the electrodes. The electrodes extend substantially parallel to each other for a distance both above and below said surface. The insulating member has a channel (recess) for receiving at least a portion of a length of at least one of said electrodes below and to said surface of the insulating member. The surface of the insulating member may preferably be augmented with a conductivity enhancing agent. The insulating member and electrodes are configured so that an electric field between the electrodes at said surface does not have abrupt field intensity changes, whereby when a potential is applied to the electrodes sufficient to cause breakdown to occur between the electrodes, discharge occurs at said surface of the insulating member to define a plasma initiation region.

20 Claims, 3 Drawing Sheets

Related U.S. Application Data continuation of application No. 16/034,173, filed on Jul. 12, 2018, now abandoned, which is a continuation of application No. 15/164,786, filed on May 25, 2016, now abandoned, which is a continuation of application No. 14/879,989, filed on Oct. 9, 2015, now abandoned, which is a continuation of application No. 14/234,756, filed as application No. PCT/US2012/048423 on Jul. 26, 2012, now abandoned.

(60) Provisional application No. 61/511,592, filed on Jul. 26, 2011.

(51) Int. Cl.

| | |
|---|---|
| ***H01T 13/34*** | (2006.01) |
| ***H01T 13/46*** | (2006.01) |
| ***H01T 13/22*** | (2006.01) |
| ***F02P 23/04*** | (2006.01) |

(58) Field of Classification Search

USPC ..... 313/141

See application file for complete search history.

(56) References Cited

U.S. PATENT DOCUMENTS

| | | | |
|---|---|---|---|
| 3,567,987 | A | 3/1971 | Schnurmacher |
| 3,788,293 | A | 1/1974 | Anderson |
| 3,842,819 | A | 10/1974 | Atkins et al. |
| 3,908,146 | A | 9/1975 | Pasbrig |
| 4,041,922 | A | 8/1977 | Abe et al. |
| 4,122,816 | A | 10/1978 | Fitzgerald et al. |
| 4,130,101 | A | 12/1978 | Jundt et al. |
| 4,366,801 | A | 1/1983 | Endo et al. |
| 4,369,756 | A | 1/1983 | Ezoe |
| 4,369,758 | A | 1/1983 | Endo |
| 4,398,526 | A | 8/1983 | Hamai et al. |
| 4,418,660 | A | 12/1983 | Endo et al. |
| 4,433,669 | A | 2/1984 | Ishikawa et al. |
| 4,448,181 | A | 5/1984 | Ishikawa et al. |
| 4,455,989 | A | 6/1984 | Endo et al. |
| 4,471,732 | A | 9/1984 | Tozzi |
| 4,487,177 | A | 12/1984 | Ishikawa |
| 4,487,192 | A | 12/1984 | Anderson et al. |
| 4,493,297 | A | 1/1985 | McIlwain et al. |
| 4,677,960 | A | 7/1987 | Ward |
| 4,760,341 | A | 7/1988 | Skerritt |
| 4,760,820 | A | 8/1988 | Tozzi |
| 4,766,855 | A | 8/1988 | Tozzi |
| 4,774,914 | A | 10/1988 | Ward |
| 4,795,937 | A | 1/1989 | Wagner et al. |
| 4,805,570 | A | 2/1989 | Davis |
| 4,841,925 | A | 6/1989 | Ward |
| 4,846,129 | A | 7/1989 | Noble |
| 4,893,605 | A | 1/1990 | Ozawa |
| 4,930,473 | A | 6/1990 | Dietrich |
| 4,996,967 | A | 3/1991 | Rosswurm et al. |
| 5,007,389 | A | 4/1991 | Kashiwara et al. |
| 5,076,223 | A | 12/1991 | Harden et al. |
| 5,131,376 | A | 7/1992 | Ward et al. |
| 5,187,404 | A | 2/1993 | Straub |
| 5,197,448 | A | 3/1993 | Porreca et al. |
| 5,207,208 | A | 5/1993 | Ward |
| 5,211,142 | A | 5/1993 | Matthews et al. |
| 5,215,066 | A | 6/1993 | Narishige et al. |
| 5,228,425 | A | 7/1993 | Simons |
| 5,377,633 | A | 1/1995 | Wakeman |
| 5,423,306 | A | 6/1995 | Trigger et al. |
| 5,429,103 | A | 7/1995 | Rich |
| 5,456,241 | A | 10/1995 | Ward |
| 5,513,605 | A | 5/1996 | Weldon |
| 5,517,961 | A | 5/1996 | Ward |
| 5,555,862 | A | 9/1996 | Tozzi |
| 5,564,403 | A | 10/1996 | Codina et al. |
| 5,619,959 | A | 4/1997 | Tozzi |
| 5,731,654 | A * | 3/1998 | Benedikt ..... H01T 13/52 313/131 R |
| 5,754,011 | A | 5/1998 | Frus et al. |
| 5,704,321 | A | 6/1998 | Suckewer et al. |
| 6,131,542 | A | 10/2000 | Suckewer et al. |
| 6,131,555 | A | 10/2000 | Tozzi et al. |
| 6,321,733 | B1 | 11/2001 | Suckewer et al. |
| 6,474,321 | B1 | 11/2002 | Suckewer et al. |
| 6,553,981 | B1 | 4/2003 | Suckewer et al. |
| 6,568,362 | B2 | 5/2003 | Whealton et al. |
| 6,603,245 | B1 * | 8/2003 | Fletcher ..... H01T 13/462 313/142 |
| 6,662,793 | B1 | 12/2003 | Allen et al. |
| 6,670,777 | B1 | 12/2003 | Petruska et al. |
| 6,729,317 | B2 | 5/2004 | Kraus |
| 6,814,047 | B2 | 11/2004 | Vogel et al. |
| 6,924,608 | B2 | 8/2005 | Czemichowski et al. |
| 7,095,181 | B2 | 8/2006 | Frus et al. |
| 7,121,270 | B1 | 10/2006 | Plotnikov |
| 7,467,612 | B2 | 12/2008 | Suckewer et al. |
| 7,518,085 | B1 | 4/2009 | Krishnan |
| 7,714,488 | B2 | 5/2010 | Nagasawa et al. |
| 8,186,321 | B2 | 5/2012 | Suckewer et al. |
| 8,622,041 | B2 | 1/2014 | Suckewer et al. |
| 10,859,058 | B1 * | 12/2020 | Rothenbuhler ..... F02P 13/00 |
| 11,419,204 | B2 | 8/2022 | Suckewer et al. |
| 2002/0170547 | A1 | 11/2002 | Lepley |
| 2003/0154954 | A1 | 8/2003 | Vogel et al. |
| 2005/0000500 | A1 | 1/2005 | Goede |
| 2005/0000655 | A1 | 1/2005 | Wi |
| 2005/0016511 | A1 | 1/2005 | Romero et al. |
| 2006/0137354 | A1 | 6/2006 | Ponziani et al. |
| 2007/0062502 | A1 | 3/2007 | Suckewer et al. |
| 2008/0141967 | A1 | 6/2008 | Tani et al. |
| 2009/0194513 | A1 | 8/2009 | Suckewer et al. |
| 2011/0309749 | A1 | 12/2011 | Suckewer et al. |
| 2014/0091712 | A1 | 4/2014 | Suckewer et al. |
| 2014/0232256 | A1 | 8/2014 | Suckewer |
| 2016/0381779 | A1 | 12/2016 | Suckewer et al. |
| 2017/0085059 | A1 | 3/2017 | Suckewer |
| 2017/0105275 | A1 | 4/2017 | Suckewer et al. |
| 2018/0359844 | A1 | 12/2018 | Suckewer et al. |
| 2018/0368247 | A1 | 12/2018 | Suckewer et al. |
| 2019/0027903 | A1 | 1/2019 | Suckewer |
| 2020/0367352 | A1 | 11/2020 | Suckewer et al. |
| 2020/0373742 | A1 | 11/2020 | Suckewer et al. |
| 2021/0059038 | A1 | 2/2021 | Suckewer et al. |
| 2022/0030694 | A1 | 1/2022 | Suckewer et al. |

FOREIGN PATENT DOCUMENTS

| | | | |
|---|---|---|---|
| GB | 2 085 076 | A | 4/1982 |
| JP | 57-140567 | A | 8/1982 |
| WO | WO 88/04729 | A1 | 6/1988 |
| WO | WO 91/15677 | A1 | 10/1991 |
| WO | WO 93/10348 | A1 | 5/1993 |
| WO | WO 01/20160 | A1 | 3/2001 |
| WO | WO 2009/105273 | A1 | 8/2009 |

OTHER PUBLICATIONS

U.S. Appl. No. 17/396,225, filed Aug. 6, 2021, Suckewer et al.

PCT/US2006/014840, Aug. 8, 2006, International Search Report and Written Opinion.

PCT/US2012/048423, Dec. 20, 2012, International Search Report and Written Opinion.

International Search Report and Written Opinion for International Application No. PCT/US2006/014840 dated Aug. 8, 2006.

International Search Report and Written Opinion for International Application No. PCT/US2012/048423 dated Dec. 20, 2012.

U.S. Appl. No. 17/866,427, filed Jul. 15, 2022, Suckewer et al.

* cited by examiner

TRAVELING SPARK IGNITER

CROSS-REFERENCE TO RELATED APPLICATIONS

This Application is a Continuation of U.S. application Ser. No. 16/722,162, filed Dec. 20, 2019, entitled "TRAVELING SPARK IGNITER", which is a continuation of U.S. application Ser. No. 16/034,173, filed Jul. 12, 2018, entitled "TRAVELING SPARK IGNITER", which is a continuation of U.S. application Ser. No. 15/164,786, filed May 25, 2016, entitled "TRAVELING SPARK IGNITER," which is a continuation of U.S. application Ser. No. 14/879,989, filed Oct. 9, 2015, entitled "TRAVELING SPARK IGNITER," which is a continuation U.S. Application No. of Ser. No. 14/234,756, filed Apr. 1, 2014, entitled "TRAVELING SPARK IGNITER," which is a national stage application under 35 U.S.C. § 371 of International Patent Application No. PCT/US2012/048423, filed Jul. 26, 2012, and entitled "TRAVELING SPARK IGNITER," which claims the benefit, under 35 USC 119(e), of U.S. Provisional Application No. 61/511,592, titled "TRAVELING SPARK IGNITER WITH ELECTRODES INSET IN INSULATOR," filed Jul. 26, 2011, in the name of Artur P. Suckewer, all of which applications are hereby incorporated by reference in their entireties.

BACKGROUND

The traveling spark igniter (TSI) is a device that has been discussed as a promising spark plug replacement for internal combustion engines. TSIs have, for example, been shown in a number of prior patents. For example, U.S. Pat. Nos. 5,704,321; 6,131,542; 6,321,733; 6,474,321; 6,662,793; 6,553,981; 7,467,612 and U.S. patent application Ser. No. 12/313,927 describe traveling spark ignition systems and igniters which employ Lorentz and thermal forces to propel a plasma into a combustion region (such as an engine chamber, where igniting a fuel-air mixture can be used to do useful work, or a burner for a furnace, for example). Those patents and application are hereby incorporated by reference in their entireties for their explanations of TSI devices and ignition systems.

Briefly, a TSI-based ignition system provides a plasma kernel which is propagated along the igniter's electrodes by Lorentz force (and grown with thermal forces) and subsequently, propelled into a combustion region. The Lorentz force acting on the ignition kernel (i.e., plasma) is created by way of the component of the discharge current passing through (or adjacent to) the plasma, between the electrodes, interacting with a magnetic field caused by a component of that same current in or along the electrodes of the igniter. The magnitude of the Lorentz force is proportional to the square of that current.

In engines operating at normal pressures (i.e., a maximum of about 120 psi at the time of ignition), traveling spark igniters provide significant advantages over conventional spark plugs due to the large plasma volume they generate, typically some 100-200 times larger than in a conventional spark plug, for comparable discharge energy. These advantages may include enabling increased efficiency and reduced emissions.

For higher engine operating pressures, however, the breakdown voltage required for initiating the discharge between the electrodes of the igniter is significantly higher than in engines operating at conventional pressures. This creates problems for TSIs, as for any spark plug. The electrodes in a TSI, as in a conventional spark plug, are maintained in a spaced apart relationship by a member called an isolator, which is formed of an insulating material such as a ceramic. The higher breakdown voltage causes problems for both the isolator and the electrodes.

Along the surface of the isolator running between the electrodes, the breakdown voltage is lower than it is further along the electrodes in a TSI, or in any conventional spark plug with a similar gap between the electrodes. Indeed, this difference in breakdown voltages varies directly with increasing pressure at the location of the discharge. Consequently, although the breakdown voltage along the isolator surface increases with pressure, that increase is less than the increase in the breakdown voltage between the exposed part of the electrodes away from the isolator surface. When breakdown occurs (as a result of which the resistance through the plasma rapidly drops), the current rises rapidly and a very large current is conducted in the forming plasma at the isolator surface. The magnitude of the current may then fall over time, but the initial high current and the sustained current thereafter give rise to a Lorentz force acting on the plasma for a sufficient time to propel the plasma from the igniter into the combustion region. However, the power in the rapidly rising initial current creates not only a very high temperature plasma, but also a powerful shock wave in the vicinity of the surface of the isolator. The larger the current, the more rapid the plasma expansion and the resulting shock wave. These combined effects can cause deformation and/or breakage of the isolator.

As previously reported, for example, although both the railplug and the TSI generate significant plasma motion at relatively low pressures, when the combustion chamber pressure is increased to a high pressure, the plasma behaves differently and this difference in behavior leads to unsatisfactory results. In a low pressure environment, the force exerted on the plasma by the pressure is relatively small. The plasma remains diffuse and moves easily along the electrodes in response to the Lorentz force. As the ignition chamber pressure is increased, however, that pressure presents a force of significant magnitude that resists the Lorentz force and, thus, plasma motion. Consequently, the plasma tends to be or become more concentrated, and to collapse on itself; instead of having a diffused plasma cloud that is relatively easily moved, a very localized plasma—an arc—is formed between the electrodes and it is not easily propelled. This arc, though occupying a much smaller volume than the plasma cloud of the low-pressure case, receives similar energy. As a result, the current density is higher and at the electrodes, where the arc exists, there is a higher localized temperature and more power density at the arc-electrode interfaces. Concurrently, the plasma, affected by the Lorentz and thermal forces, bows out from the arc attachment points. This causes the magnetic field lines to no longer be orthogonal to the current flow between the electrodes, reducing the magnitude of the Lorentz force produced by a given current. Should this occur, in addition to the other problems, there is a loss in motive force applied to the plasma at the plasma-electrode interface. Overall, there is a reduction in plasma motion as compared with the lower pressure environments, and dramatically increased electrode wear at the arc attachment points. Thus, railplug designs previously have not generally been useful over a wide range of engine pressures, from low to average to high pressures.

As opposed to conventional ignition systems, ignition systems which use electromagnetic fields to improve plasma/spark-based ignition systems generally attempt to create a relatively uniform electromagnetic field as localized field concentrations or other 'disturbances' may cause forces acting on the plasma and/or plasma propagations to occur in undesirable secondary directions (i.e., directions other than the direction it is desired to propel the plasma) or other secondary effects to occur. Once these 'disturbances' occur, especially if they are of sufficient magnitude, it is often found that the plasma will become 'unstable' as the disturbance often causes the plasma to become 'unaligned' with the field lines. Once this occurs, the plasma may exaggerate the disturbance in an inconsistent manner, causing the plasma to differ greatly in size, location of initial formation (breakdown), position and propagation direction between successive discharge events. This inconsistency in performance can detract from ignition system functional reliability, efficiency and effectiveness, as well as igniter lifetime (factors that are always important, even at low pressures, but some of which are particularly challenging in high pressure internal combustion engines).

Improvements are thus desired in plasma-based ignition systems with induced plasma motion, to improve the uniformity of formation and propulsion of the plasma, and other important operating parameters, over a wide range of engine pressures but especially in high pressure engines.

If a traveling spark igniter is to be used in a high pressure combustion environment, a need further exists to overcome the above negative effects on the isolator material and electrodes of the igniter. That is, a need exists for an igniter and ignition system for use in high pressure combustion engines, wherein the isolator and electrodes exhibit substantial lifetimes (preferably comparable to that of conventional spark plugs in low pressure engines) without being destroyed by the discharge process or environment. It has been observed that TSI igniters wherein both electrodes are of a rail type configuration Lorentz force induced plasma motion is enhanced vs. a coaxial configuration Desirably, such a traveling spark igniter and ignition system will be usable and useful in internal combustion engines operating not only at high and very high pressures (i.e., hundreds of psi), but also at lower, conventional pressures, as well as in other combustion applications such as afterburners and augmentors.

SUMMARY

An igniter satisfying the above needs is described and certain select, example embodiments are shown and discussed herein. It is not possible to show or discuss all of the many possible variations on the theme of illustrated device, of course.

According to a first aspect, an igniter embodying certain teachings mentioned herein has at least two electrodes spaced from each other by an insulating member which has a substantially continuous surface along a path between the electrodes. The electrodes preferably extend substantially parallel to each other for a distance both above and below said surface. The insulating member is shaped (e.g., molded or machined) with a channel or recess for receiving at least a portion of a length of at least one of said electrodes below and to said surface of the insulating member. That is, the at least one of said electrodes is inset into the insulator. (In certain embodiments, it may be desirable that the channel be larger than required to simply receive the inset electrode.) When a potential is applied to the electrodes sufficient to cause breakdown to occur between the electrodes, discharge occurs at said surface of the insulating member, which thus defines a plasma initiation region.

In some embodiments, the conductivity of said surface of the insulator may be enhanced. This enhancement can be achieved in a number of ways. For example, the surface of the insulator may be doped with a conductivity-enhancing agent using any known technique for doping the insulator material. In some embodiments, the insulator is made of a ceramic material and the conductivity enhancing agent is a metallic material. In other embodiments, said surface of the insulator is at least partially coated with a conductivity-enhancing agent, such as a metallic film, a solid element, engobe or paint.

In some embodiments of the above types, the electrodes comprise at least one inner electrode and at least one outer electrode, and the insulator has for each outer electrode a recess or channel running parallel to the inner electrode and sized to partially or fully receive a said outer electrode.

In some embodiments according to any of the foregoing, the substantially continuous surface may be a substantially flat surface.

According to another aspect, an igniter has at least two electrodes spaced from each other by an insulating member having a substantially continuous surface along a path between the electrodes, the electrodes extend substantially parallel to each other for a distance both above and below said surface, the surface of the insulating member has a conductivity enhancing agent and the insulating member and electrodes are configured so that an electric field between the electrodes at said surface does not have abrupt field intensity changes, whereby when a potential is applied to the electrodes sufficient to cause breakdown to occur between the electrodes, discharge occurs at said surface of the insulating member to define a plasma initiation region.

In some embodiments according to either aspect, the electrodes remain parallel for at least 0.010" below the initiation region; at least 0.020" below the initiation region; at least 0.040" below the initiation region; at least 0.080" below the initiation region; at least 0.160" below the initiation region; or at least 0.250" below the initiation region.

As in the first aspect, in some embodiments according to this aspect, the insulator may have its surface conductivity enhanced at the plasma initiation region. For example, said surface of the insulator may be doped with a conductivity-enhancing agent. Or, when the insulator is of a ceramic material, the conductivity enhancement may be achieved by doping with a metallic material. Or, the insulator may be at least partially coated with a conductivity-enhancing agent such as a metallic paint or engobe.

In some embodiments, the electrodes may comprise at least one inner electrode and at least one outer electrode, said electrodes being of substantially circular cross-section and the insulator has for each outer electrode a circular or partially circular channel running parallel to the inner electrode and sized to receive a said outer electrode.

In some embodiments, the electrodes comprise at least one inner electrode and at least one outer electrode, said electrodes being of substantially circular cross-section and the insulator has for each outer electrode a circular or partially circular channel running parallel to the inner electrode and sized to receive a said outer electrode. The electrodes may comprise at least one inner electrode and at least one outer electrode and be of substantially circular cross-section.

In any of the foregoing embodiments except for the coaxial embodiment, at least one of said electrodes may be larger in cross section above said surface of the insulating member than below said surface.

A still further aspect is an igniter having at least two electrodes spaced from each other by an insulating member having a surface (e.g., a semi-surface) at least partly filling a gap between the electrodes, the electrodes extending substantially parallel to each other for a distance both above and below said surface, the insulating member being shaped with a channel for receiving at least a portion of a length of at least one of said electrodes below and to said surface of the insulating member, whereby when a potential is applied to the electrodes sufficient to cause breakdown to occur between the electrodes, said surface of the insulating member defines a plasma initiation region.

BRIEF DESCRIPTION OF THE DRAWINGS

Various aspects and embodiments of the application will be described with reference to the following figures. It should be appreciated that the figures are not necessarily drawn to scale. Items appearing in multiple figures are indicated by the same or a similar reference number in all the figures in which they appear.

DETAILED DESCRIPTION

Figure 1B:
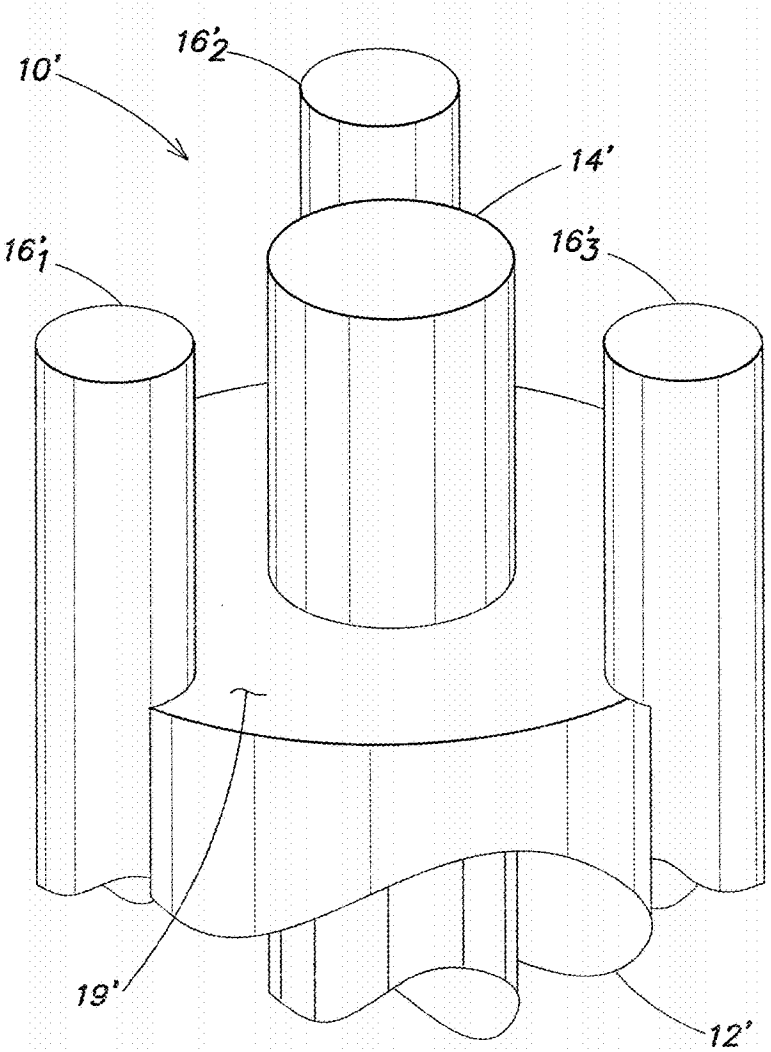
FIG. 1B is an isometric, partially cut-away view of the tip region of a second example of a plasma-based igniter embodying some of the teachings expressed herein.

As good as the igniters of the above-mentioned patents and application are, continuing efforts to improve these igniters have resulted in enhanced lifetimes and abilities to function in a wide range of engine pressure situations, particularly high engine pressure environments (i.e., those in which the pressure is at least approximately 120 psi at time of ignition, or more) as well as in other difficult and diverse combustion initiation situations. These positive results include the type of igniter embodiment shown in FIGS. 1 and 2.

Turning to those drawing figures, two examples are presented of igniters as taught herein. Each igniter, 10 and 10', respectively, comprises an isolator 12 or 12' having a central bore 13 which receives a center electrode 14 or 14' and one or more (i.e., N) outer electrodes $\mathbf{16}_1$-$\mathbf{16}_N$ or $\mathbf{16'}_1$-$\mathbf{16'}_N$, respectively. Igniters 10 and 10' are identical except for the way isolators 12 and 12' are made, so only igniter 10 will be described initially. Then the difference between the two isolators will be discussed. In these examples, N=3, though one, two, three or more outer electrodes are feasible and the invention is not limited to a specific number of outer or inner (center) electrodes. (This is not meant to imply that the orientation of the electrodes need be circular. Other configurations are certainly acceptable.)

Preferably, each of the outer electrodes is shaped in cross-section to avoid creating sharp increases in field concentration in the area of minimum "radial" separation between the electrodes (i.e., the gap). More preferably, it is a smoothly curved surface at that point, considered from a longitudinal axis of the electrode (normal to the radial direction or the like in a non-circular configuration); and this curved surface (shown in the drawings as circular, but not necessarily so) is partially inset into, and bears against, a correspondingly curved (e.g., semicircular) groove or channel 18 (see FIG. 2) in isolator 12. The diameter of the outer electrode may differ above and below the initiation region. Any suitable construction (not shown) may be used to keep the outer electrodes in place, including, but not limited to, an insulating material encircling the illustrated apparatus or simply making the outer electrodes as part of a unitary outer structure for the igniter body.

Each of igniters 10 and 10' provides a defined plasma initiation region in the vicinity of the upper surface of its isolator. In the illustrated embodiments, the electrodes are approximately parallel extending away from the initiation region, with at least one outer electrode remaining approximately parallel to an inner electrode for a distance below the surface of the isolator (essentially an insulator) separating the electrodes. The electrodes preferably may remain parallel for at least 0.010" below the initiation region, for at least 0.020," for at least 0.040," for at least 0.080," for at least 0.160," or for at least 0.250" below the initiation region.

Embodiments are contemplated, also, in which the inner and outer electrodes may not be substantially parallel. For example, the surface of the outer or inner electrode(s) may tilt or curve away from the other electrode as a function of distance from the initiation region "outward" toward the combustion region. Or an outer electrode may exhibit a change in diameter along its length, which change may be either smooth or abrupt. For example, the diameter of an outer electrode might make a step change in the vicinity of the initiation region. The change in diameter, whether smooth or abrupt might lead one to question whether such an electrode could ever be approximately or substantially parallel; however, it is intended that parallelism be assessed with reference to the axes of the electrodes, if they are substantially straight. In any event, these embodiments are within the teaching of this document as they still provide for an electric field that is free of significant abrupt changes along a path between the inner and outer electrodes in the vicinity of the initiation region.

The material forming the isolator preferably is a ceramic material, as in conventional spark plugs, but the surface region of the isolator may have its conductivity enhanced. This enhancement may be achieved in multiple ways, discussed below.

Avoiding sharp edges on the outer electrode(s) and insetting those electrodes into the insulating isolator, while maintaining a uniform spacing between inner and outer electrodes above and below the isolator surface is believed to reduce electric field concentrations and non-uniformities near the surface of the ceramic insulator, as compared to previous igniter designs of the type mentioned above, and to keep the overall electromagnetic fields correctly oriented both axially and radially (while likely compensating adequately for any intentionally introduced anomalies at the discharge initiation region—e.g., those caused by electrode diameter changes).

The plasma initiation region may be defined by a portion of the surface 19 of the insulator (isolator) 12 between the inner and outer electrodes. To reduce the voltage at which the arc discharge commences between the electrodes, and concomitantly reduce the amount of physical shock to the isolator when the breakdown occurs, the isolator material may be treated to reduce its resistivity somewhat from that of an untreated ceramic insulator material (such as aluminum oxide). Some example methods of reducing resistivity are discussed below.

The behavior of the electrical and magnetic fields in the region of the igniter/spark plug where the plasma is initially formed—i.e., the discharge initiation region—is important for forming and propelling the plasma. However, the discharge initiation region presents a challenge. A commercially useful igniter must meet a difficult set of requirements, including promoting consistent and reliable plasma formation with each firing, at a consistent initiation region; generating a sufficient and consistent Lorentz force to drive the plasma in the desired direction, even in high pressure engines; and exhibiting long life.

Others who have worked on improving railplugs have tried to accomplish similar objects by narrowing the gap between the electrodes ("rails") in order to define the discharge initiation region. This approach has been found to affect the local electromagnetic properties sufficiently as to distort the electromagnetic field locally to inhibit motion of the locus of the electrode plasma interface thus stressing the electrode material, such that the electrode material is distorted or displaced. This distortion/displacement leads to two forms of reliability issues: (1) the igniter 'wears out' due to material displacement/loss, and (2) the igniter fails to produce a consistently repeatable plasma. That happens because the required breakdown potential changes due to the local geometry at the discharge initiation region changing, which is at least partly due to electrode material distortion/displacement.

By contrast, as taught herein the discharge initiation region is created by providing at the desired location for that region a physical structure that, locally, reduces the potential necessary to achieve a breakdown in the gap between the inner and outer electrodes while minimizing the disturbance to the field when viewed in its totality. That physical structure typically is a surface of an insulator, the isolator that separates the inner and outer electrodes.

This technique allows for better control of the discharge initiation and generally improved reliability/longevity over the previously discussed railplug improvements. However, it has its own challenges, including higher stress on the ceramic insulator and changes in breakdown potential and in 'functional geometry' due to deposits of electrode material forming on the ceramic surface at or near the discharge region. As previously reported, one way of addressing some of these issues is by using a ceramic insulator having an upper surface that does not extend the entire distance between the electrodes—i.e., it is depressed, or dips, over part of that distance. This is referred to as a semi-surface discharge gap. Normally (but not always), the depression is near the cathode; thus, the discharge consistently starts at the ceramic surface at the anode (or first electrode). However, due to the gap, or dip, in the ceramic surface, between the electrodes, the termination point of the discharge on the surface of the cathode (second electrode) will normally vary over a greater region than on the anode (first electrode). This approach is particularly useful to permit an increase in the energy used during plasma initiation. However, the dip, a non-uniformity, in the isolator surface also introduces a complication, as it works at cross purposes with a desire to consistently initiate the plasma formation in a specific, localized region of the discharge zone of the igniter. With elongated inner and outer electrodes, sometimes called rails, as the potential builds prior to breakdown, the dielectric gains a charge, thus altering the electromagnetic fields during discharge, especially in the first moments of plasma and arc formation. Thus, a ceramic/electrode interface that is not substantially uniform across the majority of the interface creates inconsistencies in the field.

Instead, of using the dip, the "upper" surface 19 (or 19') of the isolator 12 (or 12') is substantially uniform and flat. A top view of the upper surface of the isolator, shown in FIG. 2, further illustrates that point, as well as showing the formation of channels 18 and bore 13 for receiving the outer electrodes and inner electrode, respectively. This situation is further shown in the cross-sectional view of the isolator as presented in FIG. 3. There, only one channel 18 is indicated since section line 3-3 cuts only one outer electrode and its channel.

To facilitate a reduction in the breakdown voltage for some embodiments, the isolator dielectric, or at least its surface, may be treated with materials, or have materials added to or placed at the surface, that allow a region at the portion of the surface of the dielectric at or near the discharge initiation region to act in a more conductive manner than would a pure nonconductive ceramic by itself. This approach allows for use of a lower voltage (potential), and usually less energy, to cause breakover/breakdown of the discharge initiation region and formation of the initial arc that supports the current which gives rise to the Lorentz force. This is particularly useful for applications in high pressure engines. Lower pressure engines may not require the isolator to be anything other than a plain ceramic.

As a first example of the conductivity-enhanced isolator, dopants such as platinum (delivered to the ceramic—e.g., alumina—while in a partially sintered state—via Chloroplatanic acid or Hydrogen hexachloroplatinate) and other metals have been shown to have beneficial significant effects. For example, as shown in FIG. 1A and indicated by the stippling of isolator 12 therein, one embodiment of a suitable structure may be produced by molding and partially sintering a powdered ceramic material such as alumina into a partially completed isolator, stopping the sintering process at a suitable point such as only about 25-30% of the total sintering time; doping the partially sintered isolator "blank" by exposing the blank to a solution of a powdered dopant in a liquid carrier such as those just mentioned, for an empirically determined appropriate time interval sufficient for the isolator to "wick" up a quantity of the dopant; removing the doped isolator from the solution and completing the temperature treatment required to finish the sintering process. Doping the ceramic in this way reduces the breakdown voltage of the igniter by about thirty to fifty percent and, in turn, reduces the wear on, and extends the life of, the igniter.

Figure 3:
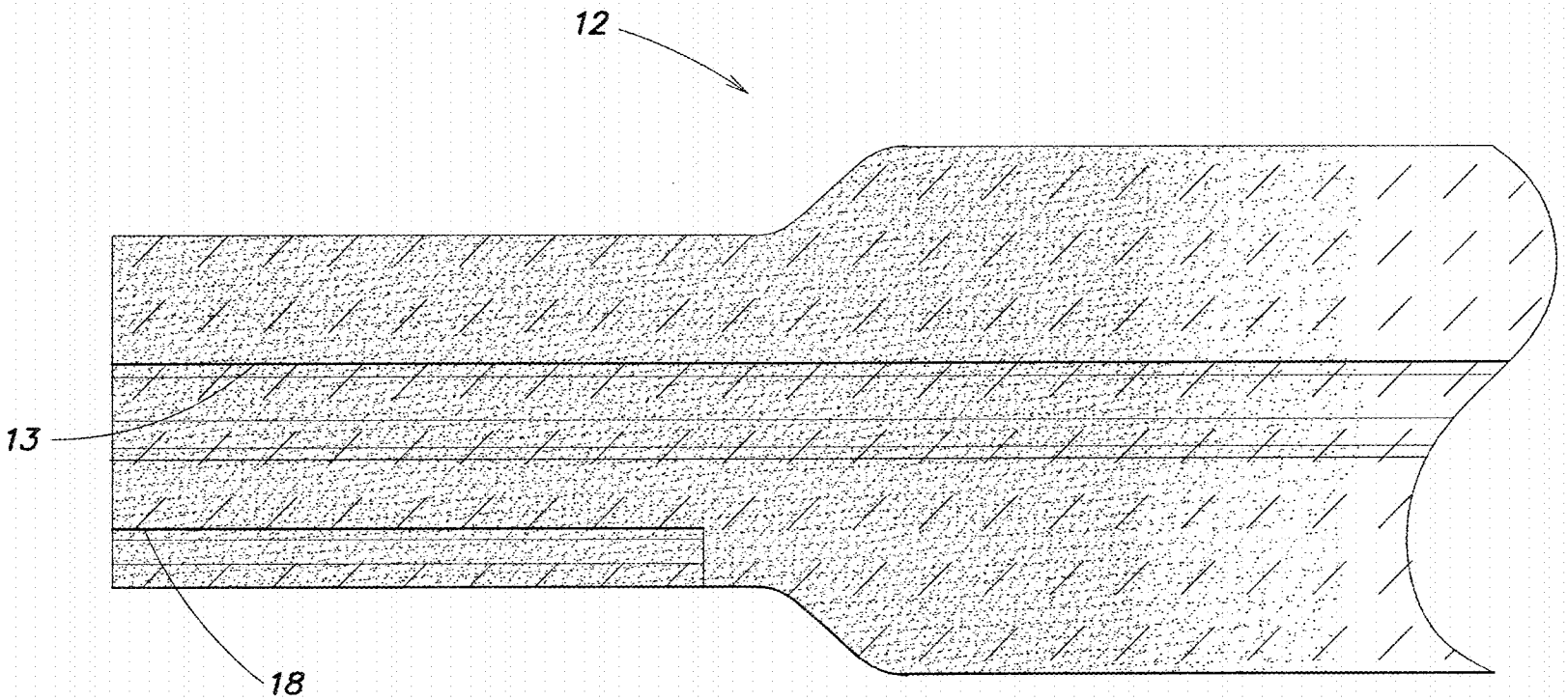
FIG. 3 is a cross-sectional view of the isolator of the FIG. 1A embodiment, taken along section line 3-3 of FIG. 1A.

While FIGS. 1A and 3 might be thought to suggest that the doping of the isolator is uniform (at least in the vicinity of the electrodes and initiation region), no such inference is intended. It is believed to be sufficient if the doping merely penetrates the isolator surface to a small depth at the initiation region and adjacent the electrodes.

The use of round cross-section electrodes and insetting the outer electrodes in round, semicircular channels in the insulator helps to orient the electromagnetic fields at the initiation region and to minimize electric field concentrations (i.e., non-uniformities) of the kind that lead to the undesirable effects mentioned above.

Figure 1A:
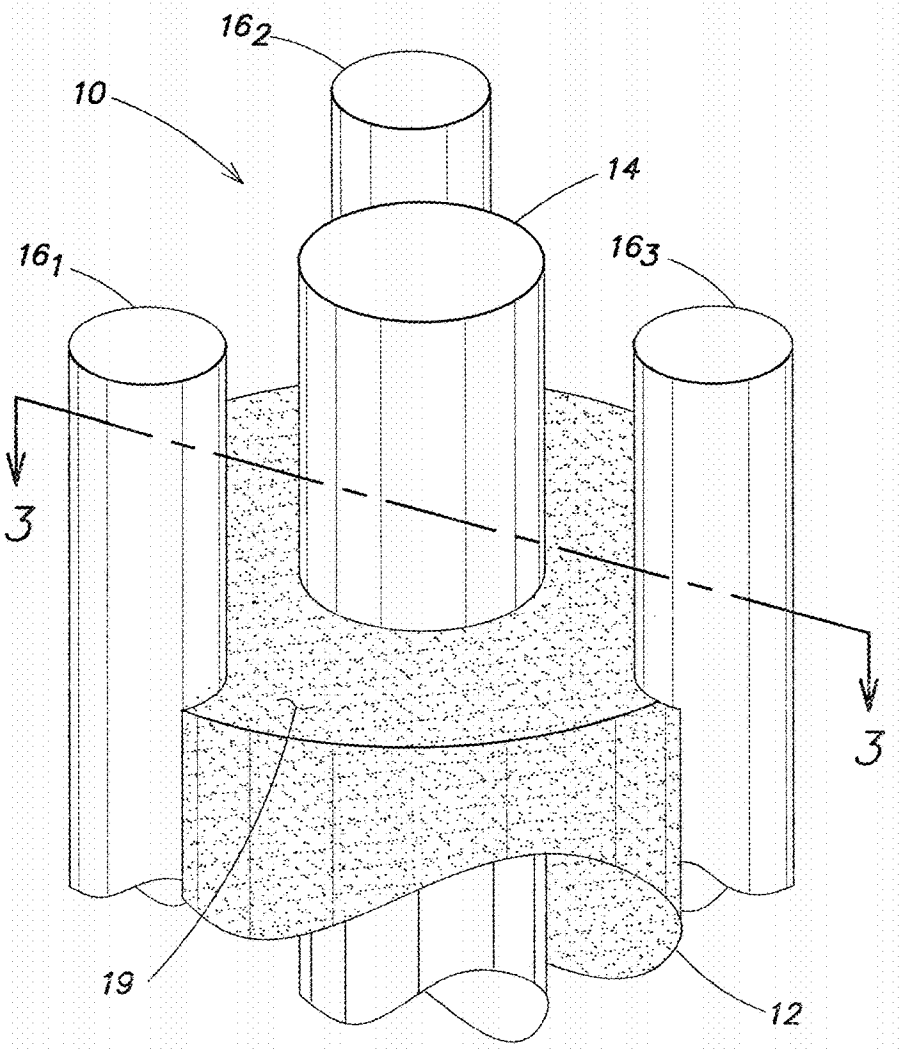
FIG. 1A is an isometric, partially cut-away view of the tip region of a first example of a plasma-based igniter embodying some of the teachings expressed herein for constructing igniters which exhibit improved performance over a range of engine pressures, from normal to high.
Figure 2:
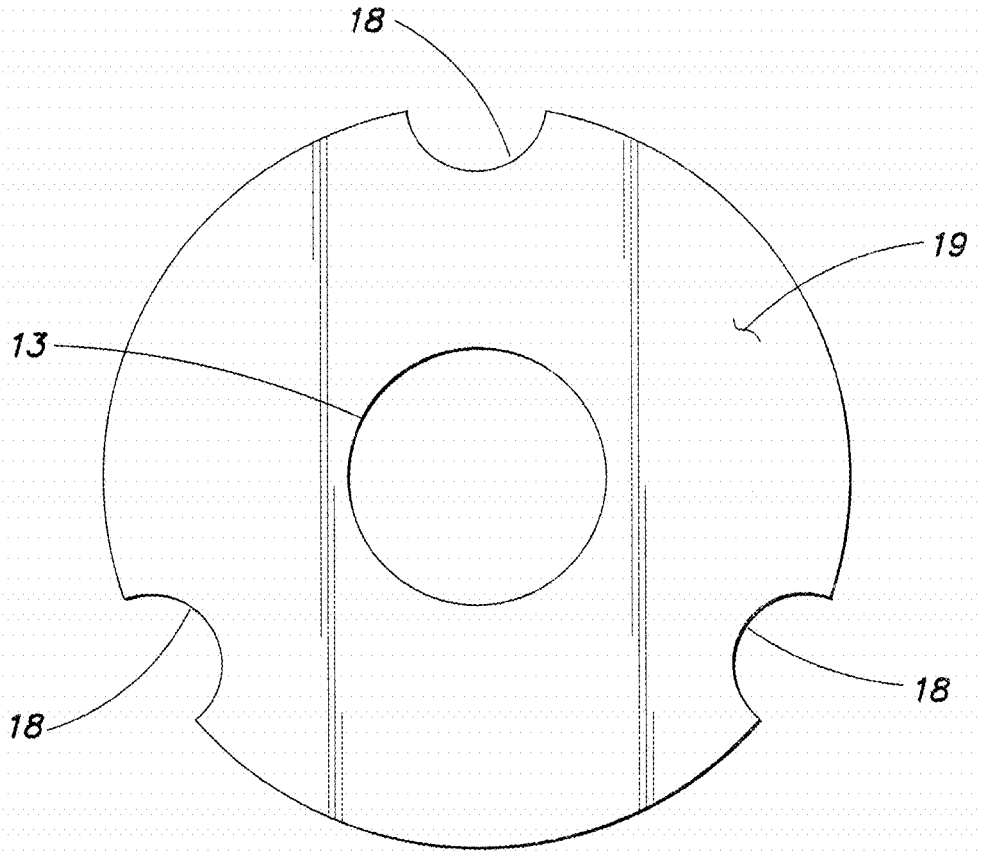
FIG. 2 is a top plan view of the end surface of isolator 18 or 18' of FIGS. 1A, 1B.

A second example of an embodiment that also enhances the conductivity of the isolator in the initiation region is shown in FIG. 1B. There, the isolator 12' is an undoped ceramic material. However, the surface of the isolator has been enhanced by the application of a very thin layer of a relatively conductive material. That material may be, for example, a metallic (e.g., gold) layer, brushed on as a paint, sprayed on, or applied through vapor deposition or other techniques. Of course, those skilled in the art understand that there are many other ways of creating an isolator with a conductivity-enhanced surface. However the conductivity enhancement is achieved, it preferably will not introduce any significant electric field non-uniformities in a path between inner and outer electrodes.

The insetting of the outer electrodes into the sides of the isolator also helps to avoid localized concentrations of the electric field so that such field is reasonably uniform at the moment of discharge initiation. This contributes to uniform, consistent and repeatable plasma formation.

In addition to the embodiments illustrated, which are examples only, it will be appreciated by those skilled in the art that other electrode structures can be used to achieve similar operation Any of the above features may be intermixed with other features in any desired arrangement, so long as they are not mutually exclusive.

While the invention has been described with respect to a limited number of embodiments, those skilled in the art, having benefit of this disclosure, will appreciate that other embodiments can be devised within the spirit and scope of the invention as disclosed herein. Accordingly, the scope of the invention should be limited only by the attached claims.

What is claimed is:

1. An igniter having at least two electrodes spaced from each other by an insulating member having a continuous surface along a path between the at least two electrodes, the at least two electrodes extending parallel to each other in a first direction for a distance both above and below said continuous surface, the insulating member being shaped with a first inset channel for receiving at least a portion of a length of a first electrode of said at least two electrodes below and to said continuous surface of the insulating member and a second inset channel for receiving at least a first side of at least a portion of a length of a second electrode of said at least two electrodes and exposing at least a second side of the portion of the length of the second electrode, the first and second sides facing in directions perpendicular to the first direction, wherein said continuous surface of the insulating member defines a plasma initiation region for when a potential is applied to the at least two electrodes sufficient to cause breakdown to occur between the at least two electrodes.

2. The igniter of claim 1, wherein said continuous surface of the insulating member is doped with a conductivity-enhancing agent.

3. The igniter of claim 2, wherein the insulating member is of a ceramic material and the conductivity-enhancing agent is a metallic material.

4. The igniter of claim 1, wherein said continuous surface of the insulating member is at least partially coated with a conductivity-enhancing agent.

5. The igniter of claim 1, wherein the first inset channel is a bore, surrounded by the insulating member, that receives the first electrode.

6. The igniter of claim 1, wherein:

the first electrode is an inner electrode; and the second electrode is one of a plurality of outer electrodes elongated in the first direction, the insulating member having, for each of the plurality of outer electrodes, an inset channel running parallel to the inner electrode and shaped to receive at least a third side of said outer electrode and to expose at least a fourth side of said outer electrode, the third and fourth sides facing in directions perpendicular to the first direction.

7. The igniter of claim 1, wherein the continuous surface is a flat surface.

8. The igniter of claim 1, wherein the at least two electrodes remain parallel for at least 0.080" below the initiation region.

9. The igniter of claim 1, wherein the second electrode has a curved surface inset into the second inset channel, the second inset channel being correspondingly curved.

10. The igniter of claim 1, wherein the second electrode has a curved surface with a convex orientation toward the first electrode in an area of minimum separation between the first and second electrodes.

11. The igniter of claim 1, wherein the first electrode is centered at a first axis and the second electrode is centered at a second axis that is radially offset from the first axis.

12. The igniter of claim 1, wherein said first and second electrodes being of circular cross-section, and the second inset channel is circular or partially circular, running parallel to the first electrode, and sized to receive said second electrode.

13. The igniter of claim 1, wherein the second electrode is part of a unitary structure coaxially oriented around the first electrode.

14. The igniter of claim 1, wherein at least one of said first and second electrodes is larger in cross-section above said continuous surface of the insulating member than below said continuous surface.

15. The igniter claim 1, wherein the at least two electrodes remain parallel for at least 0.250" below the plasma initiation region.

16. An igniter, comprising:

an insulating member shaped with:

a first inset channel;

second and third inset channels disposed on different respective sides of the first inset channel; and a surface spacing apart the first, second, and third inset channels;

a first electrode having at least a portion of a length thereof received in the first inset channel below and to the surface of the insulating member;

a second electrode having at least a portion of a length thereof received in the second inset channel below and to the surface of the insulating member; and a third electrode having at least a portion of a length thereof received in the third inset channel below and to the surface of the insulating member, wherein:

at least two of the first, second, and third electrodes are configured as an anode and a cathode, respectively; and the surface of the insulating member defines a plasma initiation region for when a potential is applied to at least the anode and the cathode sufficient to cause breakdown to occur between at least the anode and the cathode.

17. The igniter of claim 16, wherein the first inset channel is a bore, surrounded by the insulating member, that receives the first electrode, and the first electrode is configured as one of the anode and the cathode.

18. The igniter of claim 16, wherein:

the first electrode is an inner electrode and configured as one of the anode and the cathode; and the second and third electrodes are outer electrodes and each configured as anodes or each configured as cathodes.

19. The igniter of claim 16, wherein:

the first, second, and third electrodes are elongated in a first direction;

the first inset channel is shaped to fully receive surround the first electrode on sides that face in directions perpendicular to the first direction; and the second inset channel is shaped to surround the second electrode on at least a first side and expose the second electrode on at least a second side, the first and second sides facing in directions perpendicular to the first direction; and the third inset channel is shaped to surround the third electrode on at least a third side and expose the third electrode on at least a fourth side, the third and fourth sides facing in directions perpendicular to the first direction.

20. The igniter of claim 16, wherein:

the first, second, and third electrodes are elongated in a first direction;

a cross-section of the second electrode that is normal to the first direction, where the second electrode is received in the second inset channel, has a diameter smaller than the length of the second electrode in the first direction; and a cross-section of the third electrode that is normal to the first direction, where the third electrode is received in the third inset channel, has a diameter smaller than the length of the third electrode in the first direction.

* * * * *